US006834608B1

(12) United States Patent
Ansay et al.

(10) Patent No.: US 6,834,608 B1
(45) Date of Patent: Dec. 28, 2004

(54) ASSEMBLY OF UNDERWATER BODIES AND LAUNCHER THEREFOR

(75) Inventors: Michael T. Ansay, Johnston, RI (US); John R. Little, Swansea, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/600,726

(22) Filed: Jun. 23, 2003

(51) Int. Cl.[7] ..... B63G 8/00; F41F 3/00

(52) U.S. Cl. ..... 114/312; 89/1.809; 114/316; 114/320

(58) Field of Search ..... 114/312, 316, 114/320; 89/1.809, 1.81

(56) References Cited

U.S. PATENT DOCUMENTS 3,229,292 A * 1/1966 Dell Aria et al. ..... 342/8
3,605,492 A * 9/1971 Stohrer et al. ..... 73/170.34
4,003,291 A * 1/1977 Vass et al. ..... 89/1.81
4,147,124 A * 4/1979 Brooks et al. ..... 114/321
4,473,896 A * 9/1984 Loeser et al. ..... 367/131
5,666,900 A * 9/1997 Carroll et al. ..... 114/316

* cited by examiner

*Primary Examiner*—Sherman Basinger
(74) *Attorney, Agent, or Firm*—James M. Kasischke; Michael F. Oglo

(57) ABSTRACT

An assembly of underwater bodies and a launcher therefor. The assembly is adapted for mounting on a submarine outside the pressure hull. The assembly includes a launcher having a housing for enclosing an underwater body, a body support structure within the housing for supporting the body, a pressure regulator system in communication with the housing for imposing a selected pressure on an interior of the housing, a hatch pivotally mounted on the housing, and an actuator for opening the hatch to permit the body to exit the hatch, and for closing the hatch. The underwater body is a self-propelled body adapted to exit by gravity from the launcher. A release device is disposed on the launcher for releasing the body from the launcher to permit the exit of the body from the launcher by gravity.

13 Claims, 2 Drawing Sheets

ASSEMBLY OF UNDERWATER BODIES AND LAUNCHER THEREFOR

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The invention relates to the launch of bodies from submarines at various depths, and is directed more particularly to the launch of bodies, such as weapons, vehicles, and the like, from locations outside the pressure hulls of submarines.

(2) Description of the Prior Art

The United States Navy has expressed a need to carry greater payloads of weapons/vehicles on submarines and a need to launch weapons/vehicles from modular, external, payload bays. Traditionally, such bodies have been stowed inside submarine torpedo rooms, protected from the pressure and corrosiveness of the ocean environment, and then launched from the submarine torpedo tubes when needed.

Accordingly, there is a need for an assembly for underwater bodies, including an appropriate launcher therefor, which assembly is adapted to be mounted outside a submarine pressure hull, and is operable to separate the underwater bodies from the launcher by force of gravity.

SUMMARY OF THE INVENTION

An object of the invention is, therefore, to provide a launch assembly mounted outside the pressure hull of a submarine, for housing and releasing bodies underwater, and underwater bodies for exiting the launch assembly and dropping downwardly by force of gravity until well clear of the submarine, and thereafter navigating under its own power.

With the above and other objects in view, a feature of the present invention is the provision of an assembly of underwater bodies and a launcher therefor. The assembly is adapted for mounting on a submarine outside the pressure hull. The assembly includes a launcher comprising a housing for enclosing an underwater body, a body support structure within the housing for supporting the body, a pressure regulator system in communication with the housing for imposing a selected pressure on an interior of the housing, a hatch pivotally mounted on the housing, and an actuator for opening the hatch to permit the body to exit the hatch, and for closing the hatch. The assembly further includes an underwater body comprising a self-propelled body adapted to exit by gravity from the launcher. A release device is disposed on at least one of the launcher and the body for releasing the body from the launcher to permit the exit of the body from the launcher by gravity.

The above and other features of the invention, including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DESCRIPTION OF THE PREFERRED EMBODIMENTS

Figure 1:
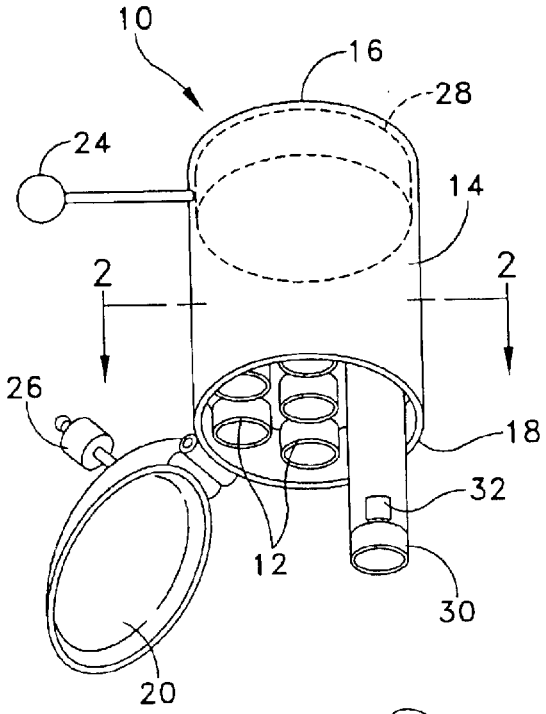
FIG. 1 is a diagrammatic perspective view of one form of an assembly of underwater bodies and a launcher therefor, illustrative of an embodiment of the invention.
Figure 2:
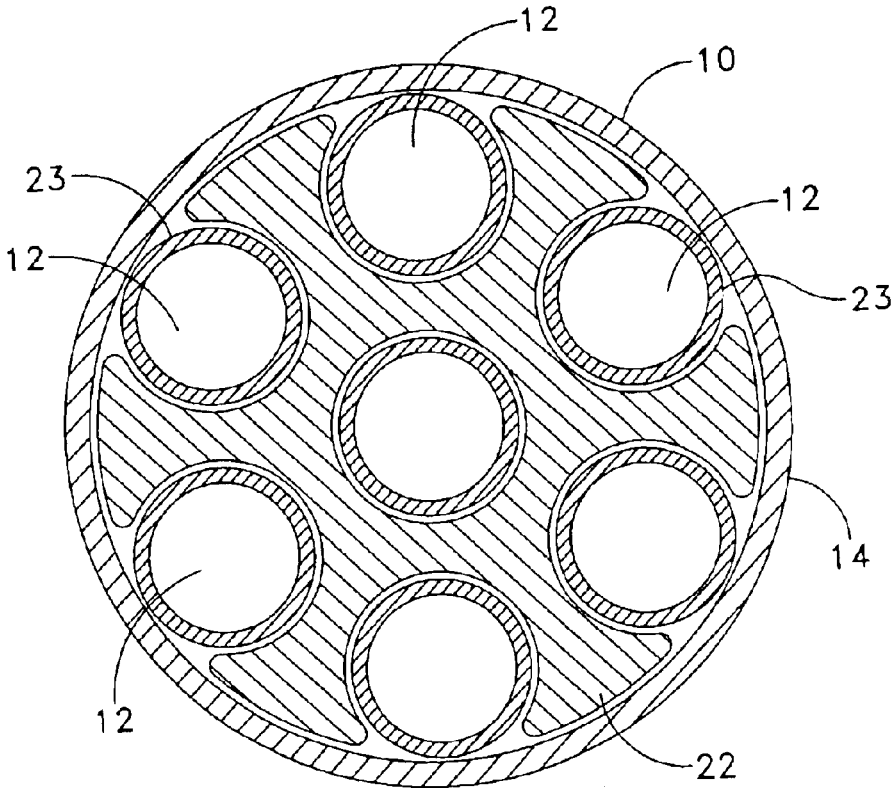
FIG. 2 is a widthwise sectional view of the assembly of FIG. 1.

Referring to FIGS. 1 and 2, it will be seen that the illustrative assembly includes a launcher 10 for retaining and selectively releasing one or more underwater bodies 12.

The launcher 10 preferably is a cylindrically-shaped housing 14 closed at an upper end 16 and open at a lower end 18. A hatch 20 is provided at the lower end 18 and is operable to close the housing lower end 18.

Disposed within the housing 14 is a support framework 22 configured to provide support for the one or more bodies 12. Preferably, the framework 22 is of a substantially rigid construction covered with an elastomeric material. Similarly, the housing 14 is of a substantially rigid material with the interior surface covered with an elastomeric material. The framework 22 loosely holds the underwater bodies 12 inside the housing 14. The elastomeric material cushions the bodies 12 against shock loads and aggressive submarine maneuvers. The framework 22 and underwater bodies occupy most of the housing interior volume. Optionally, the assembly may include rigid sleeves 23 mounted in the framework 22 and in which the bodies 12 are slidably retained.

The housing 14 and closed hatch 20 provide a water tight container which protects the bodies 12 from corrosive seawater and from high sea pressures. The container is adapted to withstand sea pressure at the deepest operating depths of the submarine on which it is mounted. The container normally is maintained at atmospheric pressure with gas, such as air.

Pressurization of the container is effected by a gas or water pressurization system 24, which typically comprises a high-pressure air flask system which may include the submarine main ballast tanks, or a gas generator. Prior to a launch, the pressurization system 24 operates to increase the pressure in the container to substantially equal the outside water pressure. A is seal is positioned around lower end 18 of housing 14. By maintaining a slight negative pressure in the container with respect to the environmental pressure, sealing of the hatch 20 against the housing 14 will be maintained.

The hatch 20 is operated by an actuator 26 which, upon equalization of pressure inside and outside the container, causes the hatch 20 to open. Inasmuch as the inside and outside pressures are substantially equal, opening of the hatch 20 is not undertaken against relatively heavy outside pressure. In a preferred embodiment, actuator 26 is a hydraulic actuator that is connected to the submarine's hydraulic system. Control of actuator 26 is provided by the hydraulic system. A sensor can be positioned on actuator 26 to indicate the position of actuator 26 and hatch 20. Other types of actuators such as pneumatic or electrical actuators can also be used for this purpose.

Inasmuch as the housing 14 is opened at the lower end 18, the pressurized air is confined to the housing, keeping the bodies 12 therein dry and free from contact with seawater.

The housing 14 is provided with a release device 28 which locks the bodies 12 in the housing, and releases a selected body upon receiving a release signal from inside the submarine.

Figure 3:
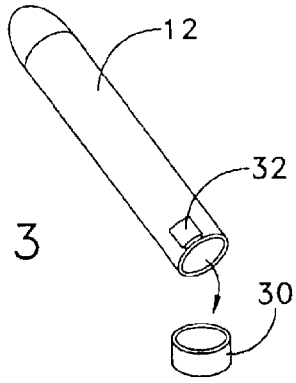
FIG. 3 is a perspective view of one underwater body released from the launcher of FIGS. 1 and 2.

Each of the underwater bodies 12 may be provided with a weight 30 which is releasably attached to the body and jettisoned after launch (FIG. 3). If the body 12 is sufficiently heavy to descend from the housing 14 the weight 30 may be omitted.

In an alternative embodiment, each of the bodies 12 is provided with an individual release mechanism 32 and held thereby, rather than by the release mechanism 28 referred to above.

In operation and in preparation for a launch, the submarine maneuvers into a position sufficiently distant from the ocean bottom to allow a body 12 to drop from the submarine. Using the gas pressurization system 24, the interior of the housing is pressurized so as to have internal pressure substantially equal to external sea pressure. Inasmuch as the bodies 12 and support framework 22 occupy most of the volume of the housing, relatively little pressurized air is required, at least with a fully loaded housing. Upon equalization of pressure, the hatch actuator 26 opens the hatch 20. A "firing" signal from the submarine serves to unlock the release mechanism in use, 28 or 32, which permits a body 12 to slide out of the framework 22 and into the sea therebelow, clear of the housing 14.

Figure 4:
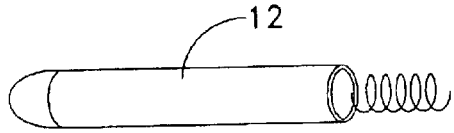
FIG. 4 is a perspective view of the underwater body of FIG. 3, after having activated its self-propelling means.

Upon clearing the housing 14, the weight 30, if used, is jettisoned and a self-propelling means is started, whereupon the launched body 12 starts its travel (FIG. 4), in accordance with a guidance system, to carry out a mission.

The hatch actuator 26 closes the hatch 20 and the gas pressurization system 24 then draws air from the housing 14 until the pressure in the housing returns to atmospheric. The withdrawn air may be exhausted or, preferably, is returned to the submarine pressurized air system.

There is thus provided a reliable and inexpensive assembly of weapons and launcher therefor, which assembly is located outside the pressure hull of the submarine. Use of the assembly herein described in lieu of the usual torpedo room arrangement eliminates the need for torpedo tubes, impulse tanks, shutter doors, inlet cylinders, missile doors, breech doors, and weapon handling and loading systems. Further, by locating the underwater bodies external to the submarine pressure hull, the weight of the bodies is greatly reduced, in view of the buoyant force difference between air and water. This difference allows for a smaller and less costly submarine volume to float the weight of the underwater bodies.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. An underwater body storage and launch assembly adapted for mounting outside the pressure hull of a submarine, the assembly comprising:

a body adapted to be negatively buoyant;

a housing for enclosing said body;

a body support structure positioned within said housing for supporting said body;

a pressure regulator system in communication with said housing for imposing a selected pressure on an interior of said housing wherein said pressure regulator system receives pressure from a selected one of the ballast tanks of the submarine and a gas generator;

a hatch pivotally mounted on said housing;

an actuator joined between said hatch and said housing for opening said hatch to permit the body to exit said hatch, and for closing said hatch; and a release means disposed between at least one of said housing and said body support structure and said body for releasing said body from said body support structure to permit the exit of said body by gravity.

2. The assembly in accordance with claim 1 further comprising a weight fixed to said body to assist in the exiting of said body from said housing, said weight being jettisonable after departure of said body from said housing.

3. The assembly in accordance with claim 1 wherein said housing is water tight and is adapted to withstand pressures at depths at least equal to deepest operating depths of the submarine.

4. The assembly in accordance with claim 3 wherein said pressure regulator system is adapted to pressurize the housing interior to a pressure equal to water pressure outside the housing.

5. The assembly in accordance with claim 4 wherein said actuator is adapted to operate upon the housing interior pressure reaching about equal to the water pressure outside the housing.

6. The assembly in accordance with claim 5 wherein said actuator comprises a hydraulic actuator in communication with a hydraulic system of the submarine.

7. The assembly in accordance with claim 5 wherein said actuator comprises a pneumatic actuator.

8. The assembly in accordance with claim 5 wherein said actuator comprises an electrical actuator.

9. The assembly in accordance with claim 4 wherein said pressure regulator system draws air from the high pressure air system of the submarine and is adapted, after launch of said body and closure of said hatch, to draw air from said housing and return the drawn air to the submarine.

10. The assembly in accordance with claim 1 wherein said body support structure comprises a framework for holding said body inside said housing, and said release means is fixed in said housing for retaining said body in place until said release means is operated in response to a launch signal to release said body.

11. The assembly in accordance with claim 10 wherein said framework is covered by an elastomeric material.

12. The assembly in accordance with claim 1 wherein said assembly further includes additional underwater bodies, the bodies and body support structure therefor occupying most of the housing volume, leaving a minimal free volume for said pressure regulator to pressurize.

13. The assembly in accordance with claim 12 wherein said bodies comprise selected ones of weapons and vehicles.

* * * * *